United States Patent [19]

Leggett

[11] Patent Number: 4,883,119

[45] Date of Patent: Nov. 28, 1989

[54] MECHANICAL LATCHING DEVICE OPERATED BY DEAD WEIGHT AND TENSION

[75] Inventor: Henry H. Leggett, Singapore, Singapore

[73] Assignee: Eastern Oil Tools PTE Ltd., Jurong, Singapore

[21] Appl. No.: 226,386

[22] Filed: Aug. 1, 1988

Related U.S. Application Data

[62] Division of Ser. No. 145,376, Jan. 19, 1988, Pat. No. 4,828,023.

[51] Int. Cl.[4] ..... E21B 23/00

[52] U.S. Cl. ..... 166/72; 166/237

[58] Field of Search ..... 166/237, 72, 239; 294/86.17, 86.18, 86.26, 86.28, 86.3, 86.31, 86.32, 86.33

[56] References Cited

U.S. PATENT DOCUMENTS

| | | | |
|---|---|---|---|
| 2,964,942 | 12/1960 | Reed | 73/155 |
| 2,976,076 | 3/1961 | Farley | 294/86.32 X |
| 3,078,923 | 2/1963 | Tansch . | |
| 3,495,659 | 2/1970 | McGill | 166/237 X |
| 3,633,669 | 1/1972 | True et al. | 166/72 |
| 3,853,175 | 12/1974 | Boyadjieff et al. | 166/72 |
| 3,860,066 | 1/1975 | Pearce | 166/72 |
| 4,031,955 | 6/1977 | Ledet | 166/183 |
| 4,105,279 | 8/1978 | Glotin et al. | 339/117 R |
| 4,325,431 | 4/1982 | Akkerman | 166/117.5 |
| 4,340,088 | 7/1982 | Geiso | 137/629 |
| 4,386,531 | 6/1983 | Heimgartner et al. | 73/756 |
| 4,407,363 | 10/1983 | Akkerman | 166/183 |
| 4,434,847 | 3/1984 | Vasquez et al. | 166/117.5 |
| 4,454,913 | 6/1984 | Guidry et al. | 166/117.5 |
| 4,483,397 | 11/1984 | Gray | 166/250 |
| 4,524,831 | 6/1985 | Pringle | 166/322 |
| 4,527,631 | 7/1985 | Vasquez | 166/322 |
| 4,557,333 | 12/1985 | Beck | 166/374 |
| 4,687,055 | 8/1987 | Leggett | 166/72 |

OTHER PUBLICATIONS

Flopetrol Johnston, "MUST—Universal DST Real Time Surface Pressure Read Out".

*Primary Examiner*—Hoang C. Dang

*Attorney, Agent, or Firm*—James L. Jackson

[57] ABSTRACT

A mechanical latching device for repeatable latching and unlatching of downhole well tools is adapted for use in a mandrel interconnected with a tubing string of a well, the mandrel forming a downwardly directed internal shoulder. The latch mechanism incorporates a fishing neck adapted for interconnection with the downhole tool. The fishing neck is disposed in upstanding generally centralized relation within the mandrel. A collet member which may be a component part of a well service tool or which may be a component part of the latch mechanism defines pulling shoulders at the free extremity of collet fingers defined thereby. A latch retainer is disposed in movable relation about the fishing neck and is movable between latched and unlatched positions relative to the fishing neck. In the latched position the latch retainer provides external support for the collet fingers to maintain the collet fingers in latching interengagement with a pulling flank. The pulling flank may be defined either by an enlargement of the fishing neck or by an enlargement formed at the lower end of a latch actuator interconnected with the well service tool. The latch apparatus becomes latched responsive to the dead weight of the well service tool and becomes unlatched by tension applied through the well service tool.

8 Claims, 3 Drawing Sheets

MECHANICAL LATCHING DEVICE OPERATED BY DEAD WEIGHT AND TENSION

This is a divisional of application Ser. No. 145,376 filed Jan. 19, 1988 now U.S. Pat. No. 4,828,023.

FIELD OF THE INVENTION

This invention is related to the subject matter of U.S. Pat. No. 4,687,055, issued to Henry H. Leggett on Aug. 18. 1987 and entitled "WIRE-LINE CONTROLLED DOWN-HOLE SHUT-IN TOOL FOR WELLS". This invention relates generally to downhole equipment for controlling the flow of fluids in wells and for conducting various other activities in wells either on a temporary or permanent basis. More specifically, the present invention is directed to a latching mechanism for well tools which permits the repeatable, latching onto and unlatching from downhole tools by utilizing the dead weight of a tool string and tension of the tool string respectively.

BACKGROUND OF THE INVENTION

Although this invention is described herein particularly as it relates to the subject matter of the above identified U.S. Patent, it is not intended that use of the latching mechanism described herein be restricted solely to the particular downhole shut-in tool set forth in the patent. It is intended that the latching mechanism set forth herein find effective applicability with a wide range of downhole tools, including downhole shut-in tools such as are typically employed for bottom hole pressure measurement. When downhole well tools have been installed in wells such as in the production tubing tool actuation in most cases is achieved by inserting "running" tools into the well for latching onto an operative component of the downhole tool and achieving manipulation to shift the downhole tool to a desired operating condition. Such operations are typically carried out by wire line controlled tools in which a tool string is lowered into the well by a wireline system for actuation of the downhole tool.

In many cases well tools are intended to remain more or less permanently located within the tubing string of a well and in other cases, well tool are intended to be positioned in a mandrel of the tubing string for only a limited period of time for a specific purpose. Downhole shut-in tools may be permanently installed in wells and are operative within the tubing string of the well to temporarily shut-in the well so that certain activities such as bottom hole pressure measurement can take place. Regardless of the temporary or permanent nature of well tools, it is typically desirable to provide efficient mechanisms for traversing the tubing string of a well, latching onto operative components of the downhole tool and then shifting the downhole tool mechanism to a desired position. Subsequently it is desirable to return the downhole tool to its initial position and then effect efficient release of the wireline tool from its latched or secured position with the downhole tool and then removing the service tool from the well. This activity is known in the industry as "running" wireline tools. It is desirable, therefore, to provide an efficient mechanism for accomplishing operation of a downhole well tool which is located within a downhole tool mandrel such as is typically incorporated within a production tubing string. It is desirable to provide a mechanical latching mechanism that is capable of being operated by the dead weight of a wireline tool string to establish positive latching with the fishing neck of a downhole tool for operation thereof. It is also desired to provide an efficient mechanism for releasing the wireline tool string from the downhole well tool by simple application of linear tension force to permit efficient retrieval from the well.

Downhole well tools may be operated by controlling them with a running tool string which may be in the form of a wireline controlled tool running system or may conveniently take the form of a solid tool operating string such as may be composed of interconnected sections of tubing. In most cases downhole tools are serviced by wireline tool actuation systems. Well service tools may also be employed which are pumped through the tubing string to achieve upward or downward movement for latching to, operating and releasing from downhole well tools. It is also desirable, therefore, to provide a novel latching mechanism which may be employed in conjunction with fluid energized tool strings and which effectively permits latching to and actuation of downhole well tools by application of the dead weight of a tool running string and subsequently achieving effective unlatching of the tool within the tool mandrel of the tubing string upon application of tension. The latching device also permits efficient unlatching simply through upward application of force from the service tool string.

SUMMARY OF THE INVENTION

It is a primary feature of this invention to provide a novel latching mechanism for downhole tools which is capable of simple and efficient latching to and operation or control of downhole well tools within well tool mandrels upon application of the dead weight of a tool string such as a wireline controlled service tool string.

It is another feature of this invention to provide a novel latching mechanism for downhole tools which is capable of achieving unlatching of a service tool string from downhole tools simply upon upward application of upward linear force.

It is also a feature of this invention to provide a novel latching mechanism for downhole tools which is capable of being effectively and efficiently latched and unlatched relative to a fishing neck of a downhole well tool located within a tool mandrel of the tubing string of a well by a simple and effective collet mechanism that functions repeatedly upon application of linear force in either the downward or upward direction.

Briefly, the mechanical latching and unlatching concept of this invention may be incorporated with a downhole tool assembly having either an internal or external fishing neck configuration as discussed in detail herein. The embodiment with an external fishing neck consists of four basic components, i.e. a collet, a fishing neck over which the collet locates, a cylindrical collet retainer and a retainer spring. The fishing neck extends from the uppermost portion of a downhole well tool assembly of any suitable character, such as a downhole shut-in tool of the type set forth in U.S. Pat. No. 4,687,055 for example. The fishing neck is positioned upright and in centralized manner inside the housing structure of the mandrel within which the well tool is located. The fishing neck is of sufficiently small diameter as to be received within a latching collet which is lowered into assembly with the latching neck by means of a running tool string such as a wireline tool string. The dead weight of the running tool string is employed to latch the collet in place over a pulling flank of the fishing neck. In the latched position a spring urged collet retainer secures the collet fingers against release from the pulling flank of the fishing neck. By application of downward force the down hole tool may be appropriately operated by the dead weight of the running tool system. If the down hole tool is operated by upward force, the wireline running tool system is reversed, thereby applying a linear upward force or tension to the collet which in turn applies upward force to the fishing neck and the downhole tool located therebelow. Separation of the running or service tool system from the fishing neck of the downhole tool is accomplished simply by applying additional upward linear force to the wireline controlled service tool which is sufficiently great to cause releasing of the latch mechanism. The collet will automatically release from the pulling flank of the fishing neck upon application of sufficient force to the fishing neck to overcome the compression of a retainer spring of the fishing neck assembly. Following release of the collet, the fishing neck assembly and the collet will automatically return to the original configurations thereof and may repeatedly be latched and unlatched without requiring resetting or other changes in the latching system as is typical with downhole latches that are commercially available at the present time.

The invention incorporates a second or alternative embodiment which is in the form of an internal latch which employs the same basic components as described above. In this case, the downhole service tool incorporates a tubular latch actuator member forming the lower portion of the running tool string and defining a pulling flank at the lower end thereof. The latch assembly incorporates an upstanding, fishing neck in the form of an upstanding central guide member which is connected to the upper portion of the downhole tool. A latch retainer element is disposed in surrounding spaced relation with the fishing neck and is urged to a set or latching position by a compression spring. Surrounding the central guide member and positioned between the fishing neck and latch retainer is a collet which is urged upwardly by a smaller compression spring and which is linearly movable relative to the fishing neck and latch retainer. The latch retainer forms internal recesses for receiving the resilient fingers of the collet when the collet fingers are expanded radially outwardly as the running tool assembly is latched to and is released from the internal fishing neck assembly. The second or alternative embodiment of this invention functions in the same manner as the external fishing neck assembly to provide repeatable latching and unlatching. latching of the running tool string to the internal fishing neck is accomplished by downward force of a lower tubular latch actuator member which is induced by the dead weight of the running tool string. Release of the running tool string from the internal fishing neck is accomplished simply and efficiently by application of upward force to the running tool string such as by the wireline or other connecting system extending from the running tool string to the surface equipment.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof that are illustrated in the appended drawings, which drawings form a part of this specification.

It is to be noted, however, that the appended drawings illustrate only typical embodiments of this invention and are therefore not to be considered limiting of its scope, for the invention may admit, to other equally effective embodiments.

In the Drawings

FIG. 1 is a sectional view of a repeatable mechanical latch assembly for downhole tools which is constructed in accordance with the present invention and is shown in the process of becoming latched with a downhole tool;

FIG. 2 is a sectional view of the apparatus of FIG. 1 showing the position of the latch mechanism after latching has been completed;

FIG. 3 is another sectional view of the apparatus of FIG. 1 showing the latch mechanism in a position during unlatching and releasing from the latched position;

FIG. 4 is a sectional view of an internal downhole latch mechanism representing an alternative embodiment of this invention and showing the latch mechanism in a position during latching with a downhole tool;

FIG. 5 is a sectional view of the apparatus of FIG. 4 showing the internal latch mechanism in the latched position;

FIG. 6 is another sectional view of the apparatus of FIG. 4 showing the internal latch mechanism in a position during unlatching and releasing from the latched position.

DETAILED DESCRIPTION OF PREFERRED EMBODIMENTS

Figure 1:
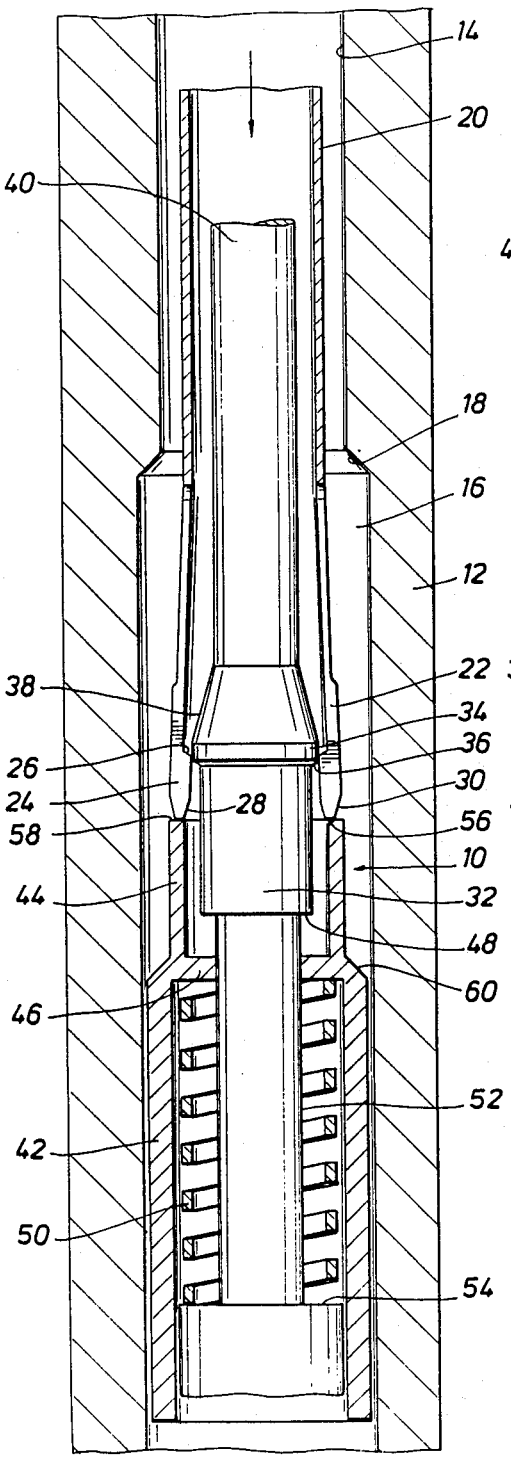
Figure 2:
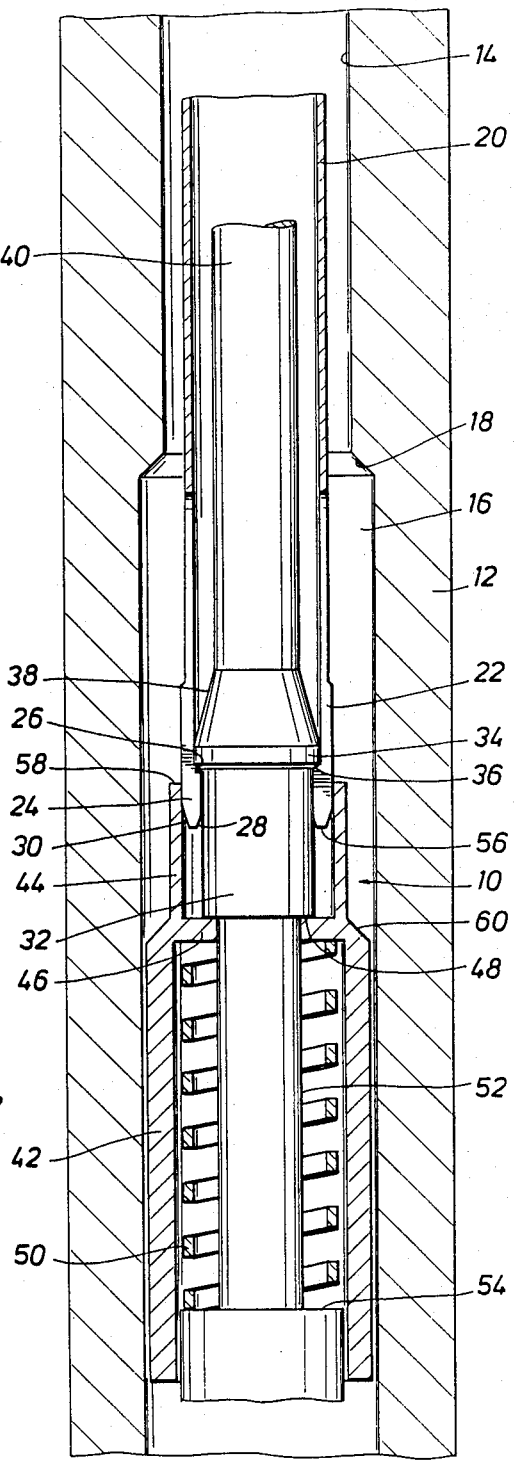
Figure 3:
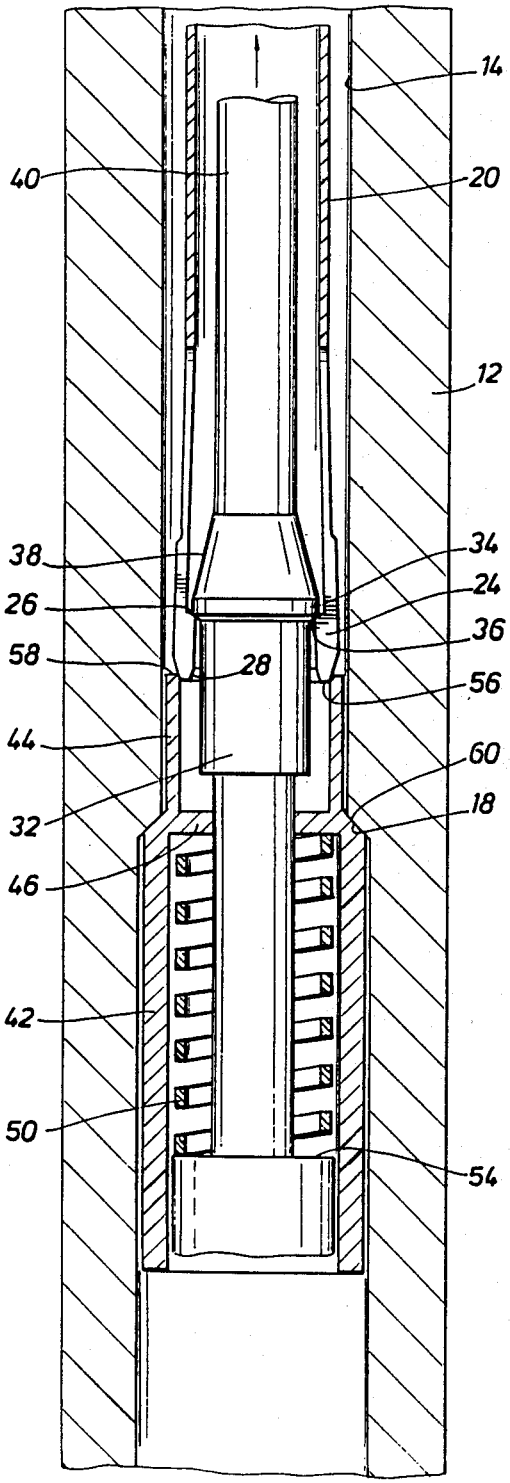

Referring now to the drawings and first to FIGS 1–3 a repeatable mechanical latching mechanism shown generally at 10 is located within the upper portion of a downhole tool mandrel 12 which may contain any appropriate type of down hole tool, for example, such as a permanently installed down hole shut-in tool of the general nature set forth in U.S. Pat. No. 4,687,055. The downhole tool mandrel is incorporated within the lower part of a production tubing string extending from the surface to the level at or near a production zone intersected by the well bore of a well for producing petroleum products. The upper end of the downhole tool mandrel 12 will typically be provided with a threaded connection for securing the mandrel to the lower threaded end of the tubing string. A section of tubing string may also be connected to the lower end of the mandrel if desired. The downhole tool mandrel 12 further defines an internal passage 14 which communicates with the flow passage of the tubing string and forms an internal chamber 16 within which the downhole tool assembly is located. At the juncture of the internal chamber and the mandrel passage 14 is formed an internal shoulder 18 which serves as a stop shoulder for restricting upward movement of the latch mechanism as will be discussed hereinbelow.

For achieving operation of the downhole tool, a running tool string is provided which is typically operated by wireline or which may take any other suitable form without departing from the sprit or scope of this invention. The running tool string has as its lower end a tubular member 20 defining a cylindrical collet 22 at its lower end, the collet forming a component part of the latch assembly. The collet 22 defines a plurality of flexible collet fingers 24 each collet finger defining an internal pulling shoulder 26. The lower ends of each of the collet fingers 24 also define internal and external tapered guide surfaces 28 and 30 to assist in centralizing the collet as the running tool string moves downwardly and insuring proper reception of the collet over the fishing neck as the collet reaches the downhole tool assembly.

The downhole tool is provided at its upper end with other component parts of the latch mechanism as illustrated in FIGS. 1–3. The latch mechanism incorporates a fishing neck 32 which defines an enlargement 34 forming a latching profile having a downwardly facing abruptly tapered pulling shoulder or pulling flank 36 and an upwardly facing gradually tapered collet expansion and guide surface 38. An upper portion 40 of the fishing neck projects upwardly into the passage 14 of the mandrel and is maintained in substantially centralized position within the passage to enable the collet 22 to be efficiently received over the fishing neck in the manner shown in FIGS. 1–3.

The lower portion of the fishing neck is surrounded by a movable latch retainer 42 of generally cylindrical form and which is provided with a cylindrical collet retainer extension 44 at the upper extremity thereof. Intermediate the latch retainer 42 is provided an internal stop flange 46 which is adapted to seat against a downwardly facing circular stop shoulder 48 of the fishing neck 32. A compression spring member 50 is disposed about a reduced diameter portion 52 of the fishing neck 32 with respective upper and lower ends thereof in abutting engagement with the internal stop flange 46 and a lower circular spring retainer shoulder 54 defined by the lower portion of the fishing neck or the upper portion of the down hole tool as the case may be.

OPERATION

With the downhole tool properly located within the mandrel 12, the fishing neck 32 with its uppermost extension 40 will be positioned in upstanding, centralized relation within the internal chamber 16 and with the upper extension 40 centralized within the passage 14 of the mandrel as shown in FIG. 1. In this position the enlargement 34 of the fishing neck will be positioned well below the level of the internal shoulder 18 of the mandrel. A running tool string with the tubular member 20 attached to the lower end thereof is then lowered through the tubing such as by a wireline tool running system. The collet 22 will be received over the upper extension 40 of the fishing neck and will move downwardly until the tapered guide surfaces 28 of the collet fingers 24 contact the gradually tapered collet guide and expansion surface 38. The collet expansion surface will both centralize the collet within the internal chamber of the mandrel and relative to the fishing neck. Further downward movement of the collet by the dead weight of the running tool assembly will cause the collet expansion surface 38 to function in cam-like manner to induce radial expansion of he collet fingers 24. The collet fingers 24 will be forced radially outward under the applied dead weight load of the running tool until the collet fingers are efficiently expanded so as to allow the collet to pass over the enlargement 34. Simultaneously, with the collet 22 expanded as it passes over the expansion profile of the fishing neck the lower end 56 of the collet defined by the collet fingers 24 will impinge in face to face relation with the upper end surface 58 of the collet retainer extension 44 of the latch retainer 42. Since the latch retainer is supported only by the compression spring 50 the latch retainer will be forced downwardly since the dead weight load of the running tool string will exceed the preload compression of the spring 50. Further downward movement of the running tool will position the internal pulling shoulder 26 of the collet fingers past the pulling flank or shoulder 36 of the enlargement 34 thereby allowing the collet fingers to quickly move with a snap action radially inwardly, providing positive engagement between the collet fingers and the pulling flank 36 should collet then be moved upwardly. When the collet fingers snap radially inwardly after pulling of the passing flank 36 the latch retainer 42 will be released by the collet and the compression spring 50 will then shift the latch retainer 42 upwardly causing the collet retainer extension 44 to move into receiving relation about the collet fingers 24. In this latched position, as shown in FIG. 2, the collet fingers are prevented from expanding and thereby maintain the internal pulling shoulders 26 in positive locking interengagement with the external pulling flank 36 of the fishing neck. The wireline running tool then may be appropriately manipulated upwardly or downwardly for application of controlling force to the downhole tool for appropriate operation thereof. It should be noted that the latch mechanism will not automatically unlatch and release from the downhole tool until upward linear force of a predetermined magnitude is applied.

After the downhole tool operation has been completed, it will be appropriate to release the running tool mechanism from the downhole tool assembly and remove the running tool from the well. This is accomplished simply upon application of upward linear force of a predetermined magnitude to the tubular member 20 such as by wireline tension. It should be noted that upward tension on the wireline of a force magnitude less than the preset unlatching force will not cause the collet to unlatch due to the restraining action of the collet retainer extension 44. To effect unlatching, sufficient force is applied to the tubular member 20 such as by wireline tension to shift the entire latch assembly upwardly until an external tapered shoulder 60 of the latch retainer 42 comes into abutting engagement with the downwardly facing internal shoulder 18 as shown in FIG. 3. After this has occurred, further upward movement of the latch retainer is prevented by the stop shoulder 60. Application of further wireline tension will cause the collet 22 and the fishing neck 32 to be moved upwardly by inducing compression to the spring member 50. This will cause the collet fingers 24 to be withdrawn from the collet retainer extension 44 thus permitting radial yielding of the collet fingers due to camming activity between the pulling flank 36 and the internal pulling shoulder 26. After the collet fingers have sufficiently expanded to clear the enlargement 34 of the fishing neck, release will have been effected and the collet 22 with its tubular member 20 will be released for extraction from the well. The compression spring 50 will then expand to its original position, thereby again returning the latch assembly to its set position for subsequent latching.

Figure 4:
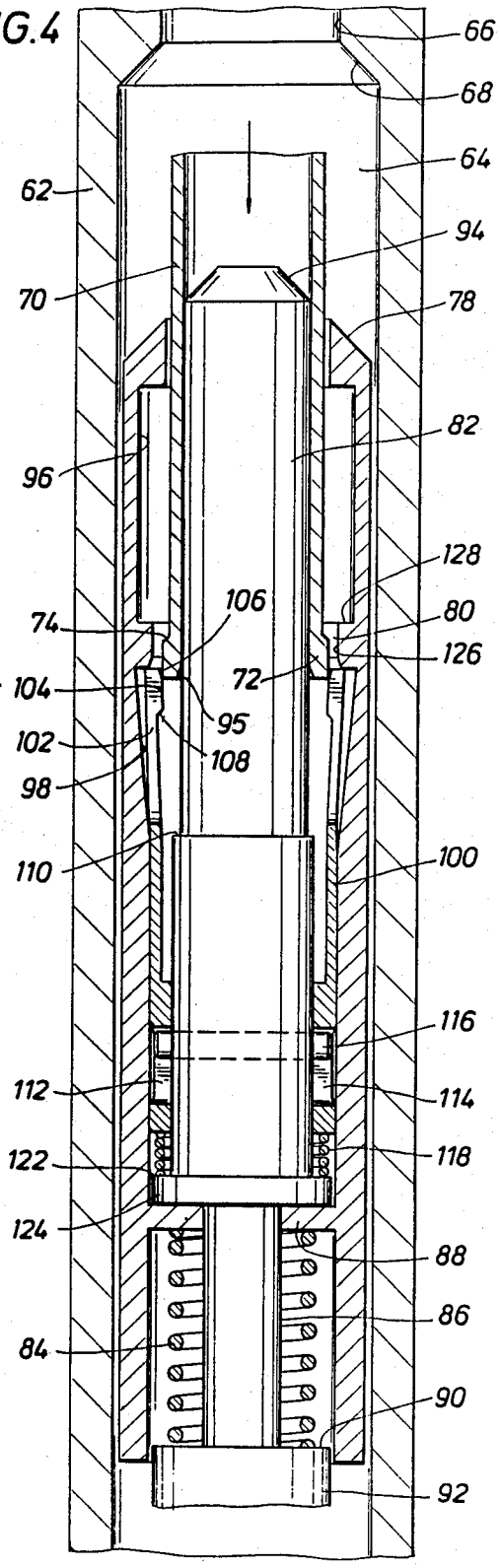
Figure 5:
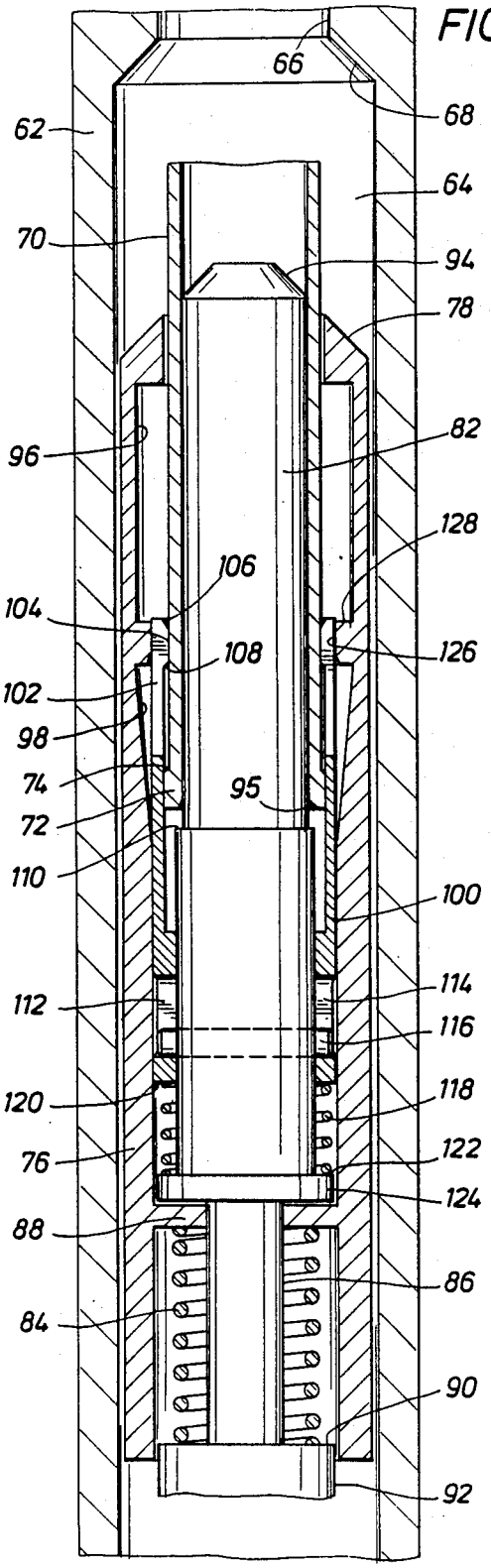
Figure 6:
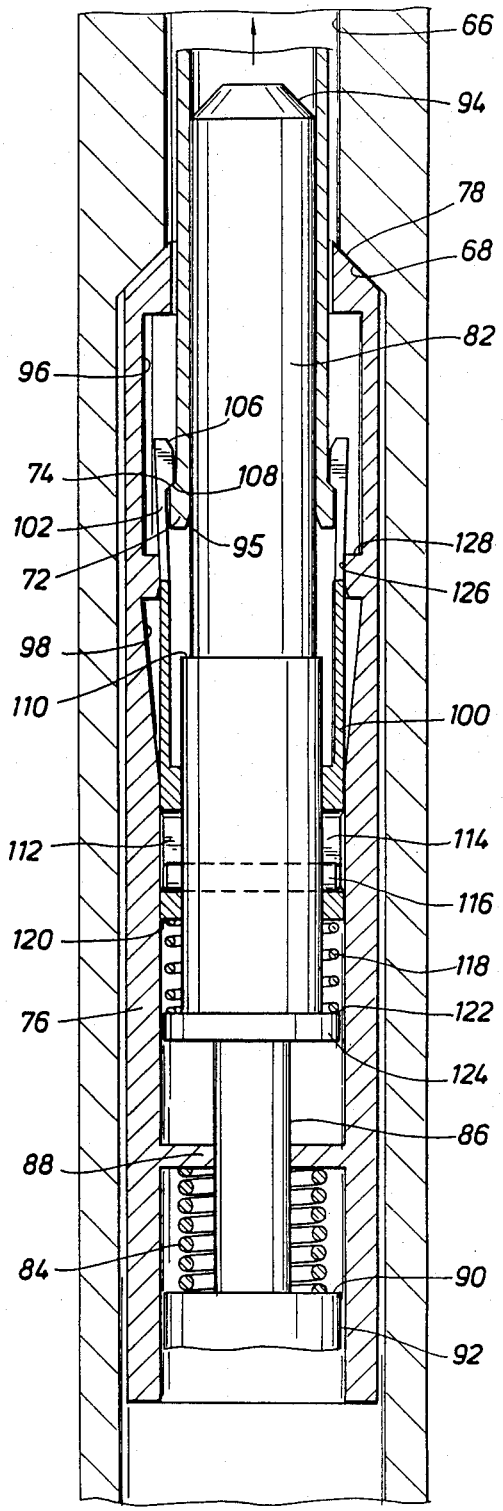

Referring now to the embodiment shown in FIGS. 4–6 there is disclosed an internal mechanical latch assembly for downhole tools which functions in the same general manner as described above in connection with FIGS. 1–3. The apparatus of FIGS. 4–6 will become latched by downward movement of a tubular member responsive to the dead weight of a running tool system. Further, the mechanism will become unlatched simply upon upward linear movement of the tubular member such as by tension applied by the running tool. Typically upward tension will be induced by a wireline system.

As shown particularly in FIG. 4, a production tubing string will be provided with a downhole tool mandrel 62 forming an internal chamber 64 which is in communication with a passage 66 extending to the passage of the tubing string to which the mandrel is connected. The mandrel forms a tapered internal stop shoulder 68 at the upper extremity of the chamber 64.

A wireline running tool string, not shown, is provided at its lower extremity with a tubular latch actuator member having an external enlargement 72 at its lower extremity forming an upwardly directed, tapered external pulling shoulder or flank 74.

Within the internal chamber 64 is provided an internal latch retainer 76 which surrounds a fishing neck 82 that is connected as the upper extremity of a downhole tool such as a downhole shut-in tool also located within the mandrel. The latch retainer forms a component part of the fishing neck by providing pulling surfaces and latch release recesses. The upper end of the latch retainer 76 forms a tapered circular surface 78 adapted for contact with the downwardly directed stop surface 68 when the latch retainer is moved upwardly to its full extent as shown in FIG. 6. The latch retainer defines an internal chamber 80 which receives the fishing neck 82 which is in the form of an elongated pin. The latch retainer member 76 is positioned and stabilized relative to the fishing neck 82 by means of a compression spring which encircles a reduced diameter portion 86 of the fishing neck member and is positioned with its upper and lower ends in abutting relation respectively with an internal flange 88 of the latch retainer and a spring retainer surface 90 formed by the lower portion 92 of the fishing neck or the upper end of the downhole tool to which the fishing neck is connected. It should be borne in mind that the fishing neck is provided at the upper end of a downhole tool mechanism which is located within the mandrel and is positioned in centralized, spaced relation within the mandrel. The upper end of the fishing neck 82 forms a tapered guide surface 94 which is adapted to be engaged by the internal tapered surface 95 at the lower end of the latch actuator 70 to thereby efficiently guide the latch actuator into properly received assembly about the fishing neck and internally of the latch retainer member.

The latch retainer 76 is formed internally to define upper and lower internal cavities or recesses 96 and 98 which are adapted to receive the collet fingers of a collet member 100 which surrounds the fishing neck 82. The collet member 100 defines upwardly directed collet fingers 102 each defining internal enlargements which project radially inwardly therefrom. The enlargements 104 of the collet fingers each define upwardly and downwardly tapered surfaces 106 and 108. The upwardly directed tapered surfaces 106 of the resilient collet fingers form guide surfaces or cam surfaces which induce radial expansion of the collet fingers upon passage of the external enlargement 72 of the latch actuator into the collet. The downwardly directed lower tapered surfaces 108 of the collet fingers function as pulling surfaces for restraining interengagement with the pulling flank 74 of the latch actuator 70. The fishing neck forms an external stop shoulder 110 which is disposed for engagement by the lower end of the latch actuator to limit downward movement of the latch actuator over the fishing neck.

The collet member 100 forms opposed external slots 112 and 114 that receive respective end portions of a collet control pin member 116 which extends through a transverse passage in the fishing neck 82. Thus, the collet member 100 is movable relative to the fishing neck 82 within limits defined by the length of the opposed slots 112 and 114. A compression spring 118 is positioned about the fishing neck with its upper ends in force transmitting engagement with the lower end 120 of the collet member 100 and a spring retainer surface 122 formed by a flange 124 of the fishing neck.

OPERATION

The latch retainer 76 and the fishing neck 82 are positioned in the manner shown in FIG. 4 during downward insertion of the latch actuator 70 by the dead weight of the running tool. The latch actuator is moved downwardly along with the wireline tool until it reaches the level of the mandrel 62. As the latch actuator moves downwardly into the internal chamber of the mandrel, its inner tapered surface 95 will first contact the upwardly directed tapered surface 94 of the fishing neck thus causing centralization of the latch actuator and causing it to slide over the external surface of the fishing neck. Simultaneously the latch actuator moves into the chamber 80 defined by the latch retainer 76 and comes into contact with the upper end of the collet member 100. As the latch actuator continues its downward movement under the influence of the dead weight of the wireline controlled running tool string the latch actuator will force the collet member 100 downwardly by further compressing the collet spring 118. As the spring fingers 102 of the collet come into registry with the recess 98 a camming activity will occur between the latch actuator and the tapered inner surfaces 106 of the collet fingers 102 thus causing the resilient collet fingers to be urged radially outwardly, thereby allowing the external enlargement 72 of the latch actuator to move downwardly to a position within the collet such as shown in FIG. 5. After the external enlargement 72 of the latch actuator has cleared the internal enlargement 104 of the collet fingers, the collet fingers due to the spring like nature thereof will snap back to the position shown in FIG. 5. As this occurs the collet member 100 will be urged upwardly to the position shown in FIG. 5 under the influence of compression spring 118. In this position the latch actuator will be fully interengaged with the latch mechanism of the downhole tool. Further downward movement of the latch actuator will establish engagement of the latch actuator with shoulder surface 110 thereby allowing the dead weight of the wireline running tool to be applied through the fishing neck to the downhole tool for actuation thereof. Upward force may also be applied through the latch assembly to the downhole tool so long as the upward force does not reach the magnitude required for automatic unlatching.

After the downhole tool operation has been completed and it is desired to return the downhole tool to its initial position and effect removal of the latch actuator from the well, such is accomplished simply upon application of upward linear force of a predetermined magnitude such as by wireline tension. As the latch actuator is moved upwardly the external pulling shoulder 74 will contact the tapered internal shoulder surfaces 108 of the collet fingers thereby developing a camming activity tending to move the collet fingers radially outwardly. Such movement of the collet fingers however will be prevented by the cylindrical surface 126 which provides the collet fingers with radial support to prevent expansion thereof. Further upward movement of the latch actuator by wireline tension will cause upwardly directed force to be transmitted through the collet and through the transverse collet control pin 116 to the fishing neck 82 thus moving the fishing neck and the latch retainer 76 upwardly until the external shoulder 78 of the latch retainer comes into abutting contact with the tapered surface 68 of the mandrel. The collet 100, being assembled about the fishing neck will be moved upwardly along with the fishing neck. After this has occurred, further upward movement of the latch actuator 70 will cause further upward movement of the fishing neck 82 by inducing further compression to the spring member 84 and moving the entire mechanism, with the exception of the latch retainer, upwardly. When sufficient upward movement of the collet member has occurred that the collet fingers clear the internal shoulder 128 of the latch retainer and move into registry with the internal recess 96, camming activity induced by interaction of the pulling flank 74 and the shoulder surfaces 108 of the collet fingers will induce radial expansion of the collet fingers. When this occurs, the external enlargement 72 will be released from the collet fingers whereupon its further upward movement may be continued for extraction of the latch actuator from the well along with the wireline control running tool. Upon release of the latch actuator from the collet the compression spring 84 will immediately return the fishing neck 82 and the latch retainer 76 to the positions shown in FIGS. 4 and 5. In this condition the apparatus will be set in readiness for relatching with the latch actuator 70. Latching and unlatching of the latch actuator 70 with respect to the latch mechanism may occur repeatedly without any requirement for resetting the apparatus. The downhole tool operation will have been carried out in simple and efficient manner such as through the use of wireline controlled equipment.

Operation of the downhole tool may be achieved as many times as is appropriate for proper service and operation of the well production system without necessitating removal of the tubing string from the well.

It is therefore seen that the present invention is one well adapted to attain all of the objects and features hereinabove set forth together with other features which are inherent from the apparatus illustrated and described herein. It is not intended that the specific apparatus disclosed be limiting in regard to the present invention but that other and various forms of the invention are possible within the spirit and scope hereof.

What is claimed is:

1. A mechanical latching device for repeatable latching and unlatching of downhole well tools, comprising:

(a) a tubular downhole tool mandrel for attachment in the tubing string of a well, said mandrel defining a downwardly directed internal stop shoulder;

(b) a fishing neck adapted for interconnection with said downhole well tool and being positioned in upstanding generally centralized relation within said mandrel and disposed for upward an downward movement within said mandrel;

(c) a collect member having a plurality of flexible collet fingers and being positioned about said fishing neck and movably disposed relative to said fishing neck, said collet fingers being radially yieldable and defining internal pulling shoulders;

(d) a compression spring being in force transmitting engagement with said collet member and said fishing neck and urging said collet member toward said latching position thereof relative to said fishing neck;

(e) a latch retainer element being received in movable relation about said fishing neck and being linearly movable from a latching position forming external support for said collet fingers to prevent radial expansion thereof to release position permitting radial expansion of said collet fingers, said latch retainer element further defining an upwardly directed latch release shoulder disposed for restraining engagement with said internal stop shoulder of said mandrel;

(f) means urging said latch retainer element to said latching position relative to said fishing neck and being yieldable upon engagement of said latch retainer element with said downwardly directed internal stop shoulder to permit the relative movement of said latch retainer element and said finishing neck to said release position upon predetermined upward movement of said fishing neck relative to said latch retainer element; and (g) latch actuator means having fixed relation with said fishing neck and forming a pulling flank for latching interengagement with said pulling shoulders of said latch fingers upon said predetermined upward movement of said latch actuator means by upward force applied to said latch actuator means by said collet member, said collet fingers being moved radially outwardly by said pulling flank of said latch actuator means thus releasing said latching interengagement between said pulling flank of said actuator means and said internal pulling shoulders of said collet fingers.

2. The mechanical latching device as recited in claim 1, wherein:

said latch retainer element is of generally cylindrical form and defines an internal chamber receiving said collet member and said fishing neck in movable relation therein, said internal chamber further receiving said latch actuator means.

3. The mechanical latching device as recited in claim 2, wherein said latch actuator means comprises:

(a) a tubular latch actuator element receiving upward and downward directed force for latch actuation, said latch actuator element forming said pulling flank at the lower external portion thereof; and (b) said collet member receiving said latch actuator element therein upon radial expansion of said collet fingers by said latch actuator element.

4. The mechanical latching device as recited in claim 3, wherein said tubular latch actuator element defines an annular external enlargement at the lower portion thereof, said annular external enlargement forming said pulling flank.

5. The mechanical latching device as recited in claim 4, wherein said latch retainer element defines upper and lower internal recesses adapted to receive said collet fingers upon radial expansion thereof, said upper internal recess receiving said collet fingers upon releasing expansion of said collet fingers by said pulling flank, said lower internal recess receiving said collet fingers upon latching expansion of said collet fingers by said external enlargement of said latch actuator element.

6. The mechanical latching device as recited in claim 5, wherein:

(a) said collet member defines opposed vertically oriented elongated slots; and (b) a collet control pin extends through said fishing neck means with opposed end portions thereof received within said opposed vertically oriented elongated slots and thereby restrict linear movement of said collet member relative to said fishing neck by the length of said opposed slots.

7. The mechanical latching device as recited in claim 6, wherein said latch retainer element forms a cylindrical internal surface providing support for said collet fingers in the latching position of said collet to thus maintain said latching fingers in locked interengagement with said latch actuator element.

8. The mechanical latching device as recited in claim 7 wherein said collet fingers define inwardly directed enlargements forming said pulling shoulders and being disposed for force transmitting engagement with said pulling flank of said external enlargement of said latch actuator element.

* * * * *